US009829194B2

(12) United States Patent
Aumann et al.

(10) Patent No.: US 9,829,194 B2
(45) Date of Patent: Nov. 28, 2017

(54) METHOD AND APPARATUS FOR EVAPORATING ORGANIC WORKING MEDIA

(75) Inventors: Richard Aumann, Munich (DE); Andreas Schuster, Tussenhausen (DE); Andreas Sichert, Munich (DE)

(73) Assignee: ORCAN ENERGY AG, Munich (DE)

( * ) Notice: Subject to any disclaimer, the term of this patent is extended or adjusted under 35 U.S.C. 154(b) by 611 days.

(21) Appl. No.: 13/883,882

(22) PCT Filed: Nov. 16, 2011

(86) PCT No.: PCT/EP2011/005778
§ 371 (c)(1),
(2), (4) Date: Apr. 23, 2015

(87) PCT Pub. No.: WO2012/065734
PCT Pub. Date: May 24, 2012

(65) Prior Publication Data

US 2016/0047540 A1 Feb. 18, 2016

(30) Foreign Application Priority Data

Nov. 17, 2010 (EP) ..... 10014706

(51) Int. Cl.
*F22B 1/18* (2006.01)
*F01K 25/10* (2006.01)
(Continued)

(52) U.S. Cl.
CPC ..... *F22B 1/18* (2013.01); *B01F 5/0485* (2013.01); *F01K 25/10* (2013.01); *F22B 35/002* (2013.01)

(58) Field of Classification Search
CPC ..... F01K 25/10–25/106; F22B 1/18; F22B 35/00; F22B 35/002; F22B 35/007;
(Continued)

(56) References Cited

U.S. PATENT DOCUMENTS 4,656,001 A * 4/1987 Roger ..... B01F 5/0485 137/13
4,996,846 A * 3/1991 Bronicki ..... F03G 7/04 60/641.2
(Continued)

FOREIGN PATENT DOCUMENTS

DE 2907694 A1 8/1980
EP 1221573 A1 7/2002
(Continued)

*Primary Examiner* — Mark Laurenzi
*Assistant Examiner* — Xiaoting Hu
(74) *Attorney, Agent, or Firm* — Moore & Van Allen PLLC; Henry B. Ward, III

(57) ABSTRACT

The present invention provides a device which comprises: a heat exchanger (1) for transferring heat of a heat-supplying medium to a working medium which differs from said heat-supplying medium, a first supply device designed to provide a flow of the heat-supplying medium at a first temperature from a heat source to the heat exchanger, and a second supply device which is designed to deliver the heat-supplying medium after it has passed through the heat exchanger, and/or a further medium at a second temperature lower than the first temperature, to the flow of the heat-supplying medium at the first temperature.

19 Claims, 3 Drawing Sheets

(51) Int. Cl.
*B01F 5/04* (2006.01)
*F22B 35/00* (2006.01)

(58) Field of Classification Search
CPC ..... F22B 1/1807; F22B 1/1815; F22G 5/04; F22G 5/06
USPC ..... 60/651
See application file for complete search history.

(56) References Cited

U.S. PATENT DOCUMENTS

| | | | | |
|---|---|---|---|---|
| 5,588,296 | A | 12/1996 | Aparici | |
| 5,632,143 | A * | 5/1997 | Fisher | F01K 23/10 60/39.181 |
| 6,782,703 | B2 * | 8/2004 | Dovali-Solis | F02C 6/18 60/39.182 |
| 7,069,716 | B1 * | 7/2006 | Childers | F01D 25/305 60/39.5 |
| 2006/0162315 | A1 | 7/2006 | Bruckner et al. | |
| 2006/0199120 | A1 * | 9/2006 | Kalina | F22B 35/002 431/9 |
| 2006/0245296 | A1 | 11/2006 | Nishioka et al. | |
| 2007/0034704 | A1 * | 2/2007 | Hu | F22B 1/1861 237/12.1 |
| 2009/0205336 | A1 * | 8/2009 | Blonn | F01K 25/06 60/649 |
| 2010/0064655 | A1 * | 3/2010 | Zhang | F01K 23/101 60/39.5 |
| 2010/0077946 | A1 * | 4/2010 | D'Agostini | F01K 3/20 110/345 |
| 2011/0000220 | A1 * | 1/2011 | Hibshman, II | F01K 23/101 60/783 |
| 2011/0048002 | A1 * | 3/2011 | Taylor | F01K 23/10 60/605.2 |
| 2011/0061388 | A1 * | 3/2011 | Lehar | F01K 23/10 60/653 |
| 2011/0120129 | A1 * | 5/2011 | Frey | F01K 25/10 60/651 |
| 2012/0260668 | A1 * | 10/2012 | Rogers | F01K 13/02 60/786 |

FOREIGN PATENT DOCUMENTS

| | | | |
|---|---|---|---|
| JP | 48100502 | A | 11/1973 |
| JP | 6128705 | A | 2/1986 |
| JP | 6296704 | A | 5/1987 |
| JP | 321604 | | 1/1991 |
| JP | 6170197 | | 6/1994 |
| JP | 2005534883 | A | 11/2005 |
| JP | 2006326571 | A | 12/2006 |

* cited by examiner

METHOD AND APPARATUS FOR EVAPORATING ORGANIC WORKING MEDIA

FIELD OF THE INVENTION

The present invention relates to an apparatus for the direct evaporation of organic working media, for the generation of electric energy from heat sources through the use of organic media.

BACKGROUND OF THE INVENTION

The operation of expansion machines, such as steam turbines, by means of the Organic Rankine Cycle (ORC) method for the generation of electric energy through the use of organic media, e.g. organic media having a low evaporation temperature, which generally have higher evaporation pressures at the same temperatures as compared to water as working medium, is known in the prior art. ORC plants constitute a realization of the Rankine cycle in which electric energy is basically obtained, for instance, by means of adibatic and isobaric changes of condition of a working medium. Mechanical energy is generated by the evaporation, expansion and subsequent condensation of the working medium, and is converted into electric energy. Basically, the working medium is brought to an operating pressure by a feed pump, and energy in the form of heat, which is provided by a combustion or a flow of waste heat, is supplied to the working medium in a heat exchanger. The working medium flows from the evaporator through a pressure pipe to an ORC turbine where it is expanded to a lower pressure. Subsequently, the expanded working medium vapor flows through a condenser in which a heat exchange takes place between the vaporous working medium and a cooling medium. Then, the condensed working medium is fed by a feed pump back to the evaporator in a cycle.

In comparison with water organic media have clearly lower decomposition temperatures, however, i.e. temperatures at which the molecular bonds of the medium break, which results in the destruction of the working medium and in the decomposition into corrosive or poisonous reaction products. Even if the temperature of the live steam is lower than the decomposition temperature of the medium, the latter can be significantly exceeded at locations that are flown through insufficiently, which may occur, above all, in areas of the heat exchanger that are exposed to vapor. Also, a failure of the feed pump entails that the flow through the heat exchanger is interrupted, so that the working medium is directly exposed to the temperature of the heat source employed for the evaporation.

In order to avoid that the working medium is heated to temperature above the decomposition temperature conventional intermediate cycles are used in the ORC plants, in which the heat is transported from the hot medium (flue gas) used for the evaporation through an intermediate cycle to the evaporator. Typically, a thermal oil is used for such an intermediate cycle, whose temperature stability is higher than that of the working medium. The single-phase heat transfer by means of the thermal oil allows a more uniform flow through the heat exchanger in which the working medium is evaporated. This solution shows the following drawbacks, however. Firstly, thermal oils are typically combustible. Therefore, to avoid the oxidation of the thermal oil, the thermal oil cycle has to be provided with a primary nitrogen pressure, which renders the plant technically complicated and expensive. In addition, thermal oils are subject to aging owing to the high thermal load, and have to be replaced at regular intervals. This results in down times of the plant, and in increased costs. Moreover, the electrical performance of the circulation pump transporting the oil results in a considerable reduction of the transferable heat and, thus, of the gained electrical power, in comparison with the direct evaporation of a working medium for which no intermediate cycle is required.

Hence, it is the object of the present invention to provide an improved ORC method which overcomes the above-mentioned disadvantaged and, in particular, can ensure a temperature of the working medium below the decomposition temperature. In the most general sense, it is the object to control the temperature on a heat exchanger such that excess temperatures can be avoided.

BRIEF SUMMARY OF THE INVENTION

The above-mentioned object is achieved by an apparatus, comprising:

a heat exchanger for transferring heat of a heat-supplying medium to a working medium which differs from the heat-supplying medium;

a first supply device adapted to supply the flow of the heat-supplying medium having a first temperature from a heat source to the heat exchanger; and a second supply device adapted to supply at least partially the heat-supplying medium, after it has passed through the heat exchanger, and/or a further medium, each having a second temperature which is lower than the first temperature, to the flow of the heat-supplying medium having the first temperature.

In particular, the heat exchanger may be provided in the form of an evaporator in which the working medium is evaporated. According to the invention the temperature of the heat-supplying medium, when it is supplied to the heat exchanger/evaporator, is not provided by the heat source alone, but it is substantially controlled by the recirculation of the heat-supplying medium, after it has passed through the heat exchanger, and/or the further medium into the flow of the heat-supplying medium which is supplied to the heat exchanger. As opposed to the prior art, this temperature control allows a more homogeneous supply to the heat exchanger, and excess temperatures on the heat exchanger can be avoided. As mentioned above, as an alternative to or in addition to the recirculation of the heat-supplying medium, after it has passed through the heat exchanger, a further medium may be added to the flow of the heat-supplying medium having the second temperature. In particular, this further medium may be ambient air which is supplied from outside of the apparatus.

In particular, the heat-supplying medium may be a hot flue gas as is produced, for instance, in the combustion of fossil fuels as heat source. The working medium may be, in particular, an organic material. The aforementioned heat exchanger may be a shell-and-tube heat exchanger, such as a smoke tube boiler or a water tube boiler, or a plate heat exchanger, in which the working medium is carried in a shell of the boiler through which the flue gas is conducted in tubes. Thus, in an example, the above apparatus is part of a steam power plant, in particular an Organic Rankine Cycle (ORC) plant. The ORC plant further comprises an expansion machine, such as a turbine, a generator, and a device for supplying the working medium evaporated in the evaporator to the turbine. From the turbine the expanded, evaporated working medium can be supplied through a conveying means (e.g. a conduit) to a condenser for the condensation thereof, and the working medium liquified there can be supplied, in a cycle process, by a feed pump back to the heat exchanger.

According to the invention, a decomposition of the organic working medium can be reliably avoided by correspondingly controlling the temperature of the heat-supplying medium below the decomposition temperature of the working medium at the heat exchanger.

According to a further development the second supply device comprises a fan or a vacuum device so as to recirculate the cooled heat-supplying medium, after it has passed through the heat exchanger, and/or the further medium into the flow supplied to the heat exchanger. A fan represents an inexpensive and efficient means for the recirculation. Alternatively or additionally, the first supply device may comprise a vacuum device to suck the medium out of the second supply device.

According to another further development the second supply device is adapted to supply the heat-supplying medium, after it has passed through the heat exchanger, and/or the further medium to the flow of the heat-supplying medium having the first temperature such that it is supplied to same distributed over the circumference of the flow. This allows a homogenous mixing of the components, for instance, of the hot flue gas directly coming from the heat source with the cooled flue gas, which is recirculated after having passed the evaporator, by avoiding the formation of hot gas strands.

In the above-described examples for the apparatus according to the invention the first supply device may comprise a first conduit for conducting the heat-supplying medium having the first temperature, and the second supply device may comprise a second conduit for conducting the heat-supplying medium, after it has passed through the heat exchanger, and/or the further medium, wherein the apparatus comprises a mixing piece or a mixing section, which is designed for a fluidic connection of the heat-supplying medium having the first temperature in the first conduit and the heat-supplying medium, after it has passed through the heat exchanger, and/or the further medium in the second conduit. The mixing piece or mixing section may be a part of the first conduit with holes formed therein in the shell of same, and a part of the second conduit surrounding the part of the first conduit (also see the detailed description below).

Also, the present invention provides for a steam power plant comprising an apparatus according to one of the above-described examples of the apparatus according to the invention. The further medium may be ambient air provided from outside or inside the steam power plant.

The above-mentioned object is also solved by a method for evaporating a working medium: in a thermal power plant, comprising the steps of:

supplying the working medium in a liquid state to an evaporator, supplying a heat-supplying medium having a first temperature, which differs from the working medium, from a heat source to the evaporator, and recirculating at least a portion of the heat-supplying medium, after it has passed through the evaporator, having a second temperature which is lower than the first temperature, and/or supplying a further medium (e.g. ambient air) into the flow of the heat-supplying medium supplied from the heat source to the evaporator.

The step of recirculating the at least one portion of the heat-supplying medium, after it has passed through the evaporator, and supplying the further medium, e.g. ambient air, can be accomplished by means of a fan and/or a vacuum device. The at least one portion of the heat-supplying medium, after it has passed through the evaporator, can be mixed with the flow of the heat-supplying medium having the first temperature and supplied from the heat source to the evaporator in a manner distributed over the circumference of this flow. The further medium, too, can be supplied over the circumference of the flow of the heat-supplying medium supplied from the heat source to the evaporator. The working medium may be or contain an organic material, and the heat-supplying medium may be or contain flue gas.

In all of the above-described examples for the method according to the invention and the apparatus according to the invention a greater flexibility can be obtained for adjusting the mixing temperature of the heat-supplying medium as it flows into the heat exchanger by heating or cooling the heat-supplying medium, as desired, after it has flown out of the heat exchanger. Thus, the above-described further developments of the method allow the heating or cooling of the heat-supplying medium, after it has passed through the evaporator and before it is supplied to the flow of the heat-supplying medium supplied from the heat source to the evaporator, to the second temperature. The further medium, too, e.g. outside air, may be heated or cooled before it is supplied to the flow of the heat-supplying medium supplied from the heat source to the evaporator.

In the above examples, the method may further comprise the steps of supplying the working medium evaporated in the evaporator to an expansion machine for expanding the evaporated working medium, of supplying the expanded, evaporated working medium to a condenser for liquifying the expanded, evaporated working medium, and of supplying the liquefied working medium to the evaporator.

BRIEF DESCRIPTION OF THE DRAWINGS

Additional features and exemplary embodiments, as well as advantages of the present invention will be explained in more detail below by means of the drawings. It will be appreciated that the scope of protection is not limited to the embodiments. It will further be appreciated that some or all of the features described below may also be combined with each other in another way.

DETAILED DESCRIPTION OF THE INVENTION

Figure 1:
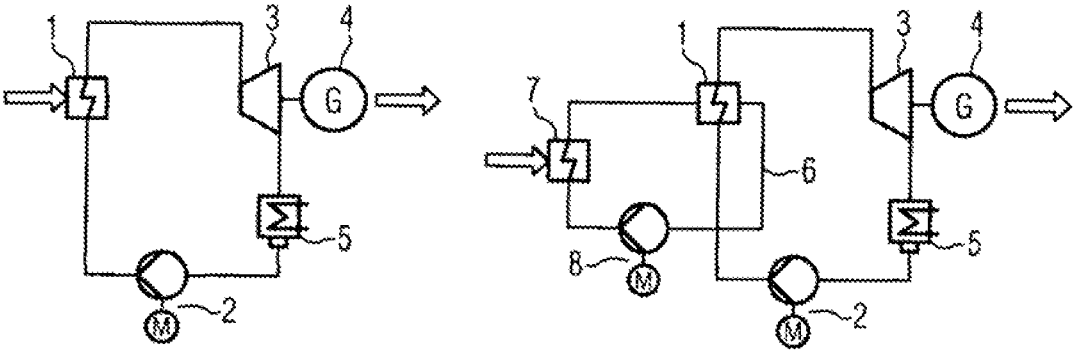
FIG. 1 (Prior Art)
FIG. 1 represents a schematic diagram of a conventional ORC plant without (left) and including (right) an intermediate cycle.

FIG. 1 shows a conventional ORC plant based on direct evaporation (left) and including an intermediate cycle (right). An evaporator 1 acting as a heat exchanger is supplied with heat from a heat source (not shown), e.g. by a flue gas which is produced in the combustion of a fuel, as is shown by the left arrow in the left part of FIG. 1. In the evaporator 1 heat is supplied to a working medium supplied by a feed pump 2. It is, for instance, fully evaporated, or evaporated by means of flash evaporation downstream of the heat exchanger. The working medium vapor is conducted through a pressure pipe to a turbine 3. In the turbine the working media vapor is expanded, and the turbine 3 drives a generator 4 to gain electric energy (illustrated by the right arrow in FIG. 1). The expanded working medium vapor is condensed in a condenser 5, and the liquified working medium is supplied by the feed pump back to the evaporator 1.

If an intermediate cycle 6 is used, as is shown in the right part of FIG. 1, the heat transfer of the flue gas to the working medium is not directly realized at the evaporator, but by a medium, e.g. a thermal oil, of the intermediate cycle 6. The intermediate cycle 6 comprises a heat exchanger 7 at which the flue gas transfers heat to the medium of the intermediate cycle 6. A pump 8 supplies the medium of the intermediate cycle 6 to the heat exchanger 7. The medium of the intermediate cycle 6 flows from the heat exchanger 7 to the evaporator 1 resulting in the evaporation of the working medium, which is supplied to the turbine 3.

Figure 2:
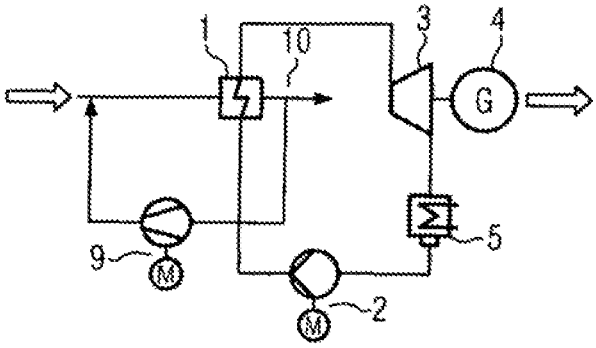
FIG. 2 represents a schematic diagram of an example of an ORC plant according to the present invention.

FIG. 2 shows an exemplary embodiment of the present invention. Elements that were already described in connection with the prior art shown in FIG. 1 are provided with the same reference numbers. As opposed to the prior art, the medium (e.g. a flue gas), which is used for evaporating the working medium, is partially recirculated to the ORC plant after it was supplied to the evaporator 1. Thus, after the supply to the evaporator 1, a portion of the cooled flue gas 10 is admixed to the flow of the hot flue gas coming from a heat source, for instance, by means of a (recirculating) fan 9.

The ORC plant itself can be, for instance, a geothermal or solar-thermal plant, or include the combustion of fossil fuels as heat source. Any "dry media" such as R245fa, "wet media" such as ethanol, or "isentropic media" such as R134a, which are used in conventional ORC plants, may be used as working media. Also synthetic working media on a silicone basis may be used, such as GL160.

According to the above description the embodiment shown does, therefore, not involve the risk of destruction of the working medium as a result of excess temperatures caused by system failures, e.g. a failure of the feed pump 5, or by an inhomogeneous flow of the heat-supplying medium (flue gas) through the evaporator.

Figure 3:
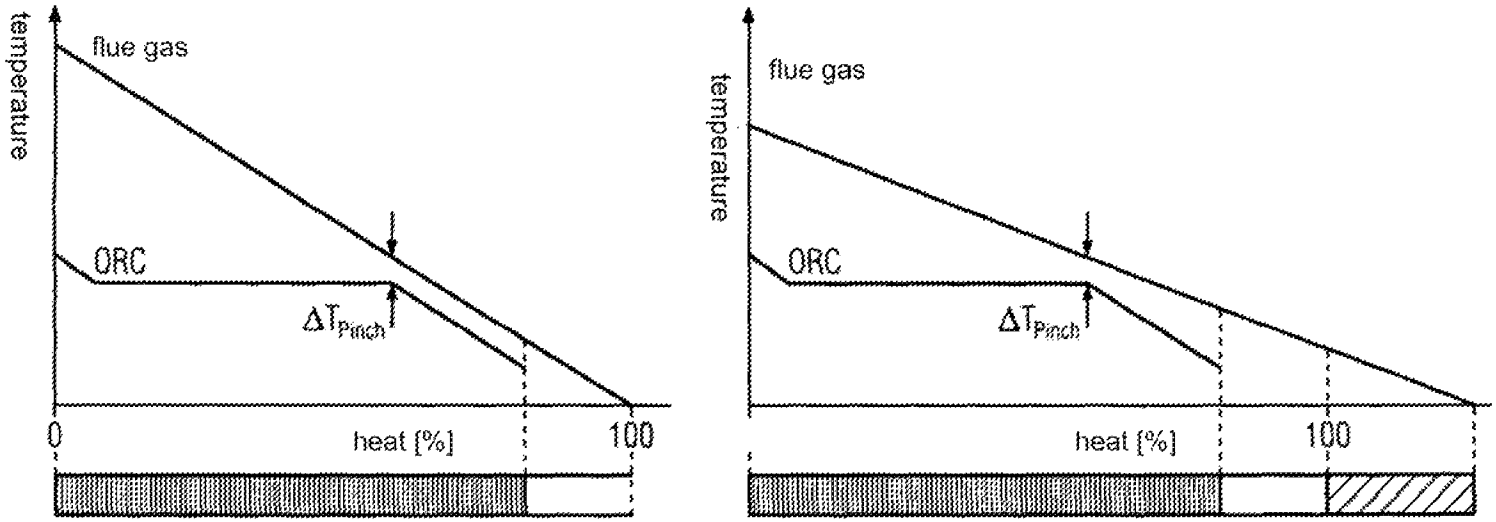
FIG. 3 shows TQ diagrams of a conventional evaporation method by means of direct evaporation (left) and the method according to the invention (right) using recirculated cooled flue gas.

This is not the only advantage of the embodiment according to the invention. FIG. 3 shows a comparison of the temperature/transferable heat (TQ) diagrams of a conventional evaporation method by means of direct evaporation (left) and the method according to the invention on the basis of the recirculated cooled flue gas. As opposed to the direct supply of the evaporator 1 with hot flue gas, the inlet temperature of the heat-transporting medium at the evaporator 1 falls when applying the recirculation of at least a portion of the cooled flue gas after it has passed through the evaporator 1. Moreover, the slope of the cooling curve decreases, however, not as strongly as would be caused by the mere reduction of the flue gas temperature, as this effect is partially compensated by the greater mass flow.

The residual heat of the recirculated cooled flue gas, which simply gets lost in conventional methods, is available again for the heat transfer in the evaporator 1. In the illustration on the right of FIG. 3 this is marked by a hatched bar. The pinch point of the closest approximation of the TQ curves of flue gas and working medium is located at the end of the preheater, which is typically connected upstream of the evaporator 1 or can be regarded as a part of same. Thus, the heat transferable in the evaporator 1 is not reduced if the pinch point temperature $\Delta T_{Pinch}$ (temperature difference between heat-dissipating (relatively hot) and heat-absorbing (relatively cold) mass flow—in this case the difference at the point of the closest approximation of the TQ curves of flue gas and working medium) is kept constant.

As compared with the conventional method the temperature gradient between the temperature of the mixed flue gas as it flows into the evaporator 1 and the temperature of the flue gas as it flows out of the evaporator 1 is smaller. However, as the evaporator 1 is flown through by a greater mass flow per unit time the heat transfer coefficient U increases, so that an identical throughput of flue gas theoretically requires no significant enlargement of surface A of the evaporator. In practice, one will adapt the surface, however, to avoid too strong an increase of the exhaust gas back pressure. The transferable heat flow per unit time of the evaporator 1 is determined by $U \cdot A \cdot \Delta T_M$, $\Delta T_M$ denoting the mean logarithmic driving temperature difference. Typical rates for the recirculation mass flow are in the range of 10 to 60% of the flue gas mass flow for mixing temperatures of 300° C. to 200° C. as the flue gas flows into the heat exchanger.

According to the invention, the additional amount of heat of the recirculated gas results in a downward tendency of the effect of the reduction of the transferable amount of heat due to the lower flue gas inlet temperature.

In the simplest case the mixing of the hot flue gas supplied from a heat source to the evaporator 1 with the cooled flue gas, after it has passed through the evaporator 1, may be accomplished by a Y tube section. However, in a mixture thus realized hot strands may occur in the mixed gas, leading to an inhomogeneous supply of the evaporator 1. Basically, a conventional gas mixer according to the prior art may be employed.

Figure 4:
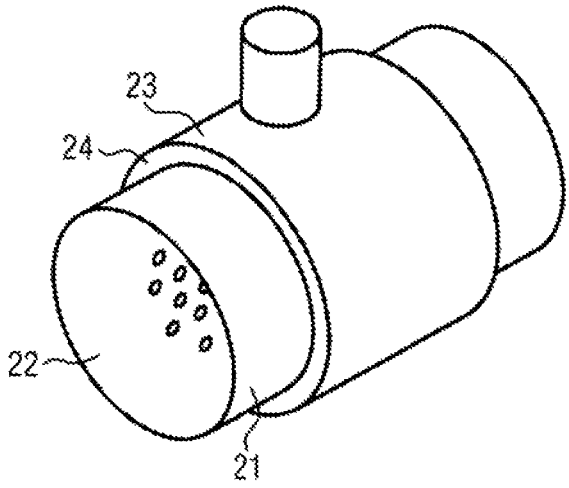
FIG. 4 shows an illustration of a mixing piece for mixing hot flue gas and cooled recirculated flue gas.

A better mixing can be obtained if the cooled flue gas, after it has passed through the evaporator 1, is supplied to the hot flue gas flow in a manner distributed over the circumference of same. For instance, the mixture may be accomplished by a mixing piece, which comprises a part 21 of a first conduit for conducting the hot flue gas flow with holes 22 formed therein in the shell of same, and a part 23 of a second conduit for conducting the recirculated flue gas, wherein part 23 of the second conduit surrounds part 21 of the first conduit and is sealed outside same, with same, by a gasket 24, as is illustrated in FIG. 4. The recirculated flue gas pressurized by a fan is pressed through holes 22 in the part of the shell of the first conduit into same so as to allow a homogeneous mixing thereof with the hot flue gas.

The invention claimed is:

1. Organic Rankine Cycle apparatus, comprising:

a heat exchanger for transferring heat of a heat-supplying medium to an organic working medium which differs from the heat-supplying medium;

a first supply device adapted to supply a flow of the heat-supplying medium having a first temperature from a heat source to the heat exchanger;

a second supply device adapted to supply at least partially the heat-supplying medium, after the heat-supplying medium has passed through the heat exchanger, and/or a further medium, each of the heat-supplying medium and the further medium having a second temperature that is lower than the first temperature, to the flow of the heat-supplying medium having the first temperature such that the temperature of the heat-supplying medium at the heat exchanger lies below a decomposition temperature of the organic working medium; and a device adapted to heat or cool the heat-supplying medium, after the heat-supplying medium has passed through the heat exchanger, and/or the further medium to the second temperature before the heat-supplying medium, after passing through the heat exchanger, and/or the further medium is supplied to the flow of the heat-supplying medium supplied from the heat source to the heat exchanger.

2. The Organic Rankine Cycle apparatus according to claim 1, wherein the first supply device comprises a vacuum device and/or the second supply device comprises a fan and/or a vacuum device.

3. The Organic Rankine Cycle apparatus according to claim 2, wherein the second supply device is adapted to supply the heat-supplying medium, after passing through the heat exchanger, and/or the further medium to the flow of the heat-supplying medium having the first temperature such that the heat-supplying medium, after passing through the heat exchanger, and/or the further medium is supplied to same distributed over a circumference of the flow.

4. The Organic Rankine Cycle apparatus according to claim 1, wherein the second supply device is adapted to supply the heat-supplying medium, after passing through the heat exchanger, and/or the further medium to the flow of the heat-supplying medium having the first temperature such that the heat-supplying medium, after passing through the heat exchanger, and/or the further medium is supplied to same distributed over a circumference of the flow.

5. The Organic Rankine Cycle apparatus according to claim 4, wherein the first supply device comprises a first conduit for conducting the heat-supplying medium having the first temperature, and the second supply device comprises a second conduit for conducting the heat-supplying medium, after passing through the heat exchanger, and/or for conducting the further medium, and wherein the apparatus comprises a mixing piece or a mixing section, which is designed for a fluidic connection of the heat-supplying medium having the first temperature in the first conduit and the heat-supplying medium, after passing through the heat exchanger, and/or the further medium in the second conduit.

6. The Organic Rankine Cycle apparatus according to claim 5, wherein the mixing piece or mixing section comprises a part of the first conduit with holes formed therein in a shell of same, and a part of the second conduit surrounding the part of the first conduit.

7. The Organic Rankine Cycle apparatus according to claim 1, which further comprises an expansion machine, a generator, and a device for supplying the working medium evaporated in the heat exchanger to the expansion machine.

8. The Organic Rankine Cycle apparatus according to claim 1, further comprising an expansion machine and a generator and a condenser, wherein the latter is adapted to condense the working medium, after passing through the expansion machine, from a vaporous state into a liquid state.

9. Steam power plant comprising the apparatus according to claim 1.

10. The Organic Rankine Cycle apparatus according to claim 1, wherein a heat-transfer surface of the heat exchanger for transferring heat of the heat-supplying medium to the organic working medium is formed large enough to accommodate for an increased mass flow through the heat exchanger, due to at least partially supplying the heat-supplying medium, after passing through the heat exchanger, and/or supplying the further medium, without increased back pressure of the heat-supplying medium.

11. Apparatus, comprising:

a heat exchanger for transferring heat of a heat-supplying medium to an organic working medium that differs from the heat-supplying medium;

a first supply device adapted to supply a flow of the heat-supplying medium having a first temperature from a heat source to the heat exchanger;

a second supply device adapted to supply a further medium having a second temperature that is lower than the first temperature to the flow of the heat-supplying medium having the first temperature such that the temperature of the heat-supplying medium at the heat exchanger lies below a decomposition temperature of the organic working medium, and wherein the heat-supplying medium is or contains flue gas.

12. Method for evaporating an organic working medium in an Organic Rankine Cycle thermal power plant, comprising the steps of:

supplying the organic working medium in a liquid state to a heat exchanger, supplying a heat-supplying medium having a first temperature, the heat-supplying medium differing from the organic working medium, from a heat source to the heat exchanger, recirculating at least a portion of the heat-supplying medium, after the heat-supplying medium has passed through the heat exchanger, having a second temperature that is lower than the first temperature, and/or supplying a further medium having the second temperature which is lower than the first temperature into the flow of the heat-supplying medium supplied from the heat source to the heat exchanger such that the temperature of the heat-supplying medium at the heat exchanger lies below a decomposition temperature of the organic working medium, and cooling or heating the heat-supplying medium, after the heat-supplying medium has passed through the heat exchanger, and/or the further medium to the second temperature before the heat-supplying medium, after being passed through the heat exchanger, and/or the further medium is supplied to the flow of the heat-supplying medium supplied from the heat source to the heat exchanger.

13. The method according to claim 12, wherein the step of recirculating the at least a portion of the heat-supplying medium, after passing through the heat exchanger, and/or of supplying the further medium is accomplished by means of a fan and/or a vacuum device.

14. The method according to claim 13, wherein the at least a portion of the heat-supplying medium, after passing through the evaporator, and/or the further medium is mixed with the flow of the heat-supplying medium having the first temperature and supplied from the heat source to the heat exchanger in a manner distributed over a circumference of the flow.

15. The method according to claim 12, wherein the at least a portion of the heat-supplying medium, after passing through the heat exchanger, and/or the further medium is mixed with the flow of the heat-supplying medium having the first temperature and supplied from the heat source to the heat exchanger in a manner distributed over a circumference of this flow.

16. The method according to claim 12, wherein the heat-supplying medium is or includes flue gas.

17. The method according to claim 12, further comprising:

supplying the organic working medium evaporated in the heat exchanger to an expansion machine for expanding the evaporated organic working medium;

supplying the expanded, evaporated organic working medium to a condenser for liquefying the expanded, evaporated organic working medium; and supplying the liquefied organic working medium to the evaporator.

18. The method according to claim 12, wherein 10 to 60% of the heat-supplying medium, after passing through the heat exchanger, are recirculated.

19. Method for evaporating an organic working medium in an Organic Rankine Cycle thermal power plant, comprising the steps of:

supplying the organic working medium in a liquid state to a heat exchanger;

supplying a heat-supplying medium having a first temperature, the heat-supplying medium differing from the organic working medium, from a heat source to the heat exchanger, supplying a further medium having a second temperature that is lower than the first temperature to the flow of the heat-supplying medium supplied from the heat source to the heat exchanger such that the temperature of the heat-supplying medium at the heat exchanger lies below a decomposition temperature of the organic working medium, and wherein the heat-supplying medium is or contains flue gas.

* * * * *